United States Patent [19]

Larsen

[11] Patent Number: 4,745,844

[45] Date of Patent: May 24, 1988

[54] CONTROL BLOCK COMPRISING A PLURALITY OF VALVE UNITS FOR A PLURALITY OF HYDRAULIC DRIVES, IN PARTICULAR FORK LIFT TRUCKS

[75] Inventor: Sönke Larsen, Marktheidenfeld, Fed. Rep. of Germany

[73] Assignee: Mannesmann Rexroth GmbH, Lohr/Main, Fed. Rep. of Germany

[21] Appl. No.: 13,377

[22] Filed: Feb. 11, 1987

[30] Foreign Application Priority Data

Feb. 18, 1986 [DE] Fed. Rep. of Germany ..... 3605140

[51] Int. Cl.[4] ..... F01B 25/02

[52] U.S. Cl. ..... 91/6; 91/530; 91/531; 91/451; 60/484

[58] Field of Search ..... 91/530, 531, 6, 451; 60/484

[56] References Cited

U.S. PATENT DOCUMENTS 3,606,820 9/1971 Thomas et al. ..... 91/526
3,959,969 6/1976 Tittmann et al. ..... 60/484
4,215,622 8/1980 Chichester ..... 91/530
4,561,341 12/1985 Aikawa ..... 91/6

FOREIGN PATENT DOCUMENTS 3510283 9/1922 Fed. Rep. of Germany .
2937814 9/1979 Fed. Rep. of Germany .
57103912 12/1980 Japan .

*Primary Examiner*—Edward K. Look
*Assistant Examiner*—Thomas E. Denion
*Attorney, Agent, or Firm*—Harness, Dickey & Pierce

[57] ABSTRACT

A control block is made up of a plurality of directional valves which serve to actuate a plurality of hydraulic drives to which in some cases a different pressure is to be supplied. For this purpose two pressure-limiting valves adjustable to different pressures are provided, the valve adjustable to the lower pressure being connected to the last valve unit. This gives a simple construction and substantial freedom in the association of the drives.

7 Claims, 2 Drawing Sheets

Figure 1:
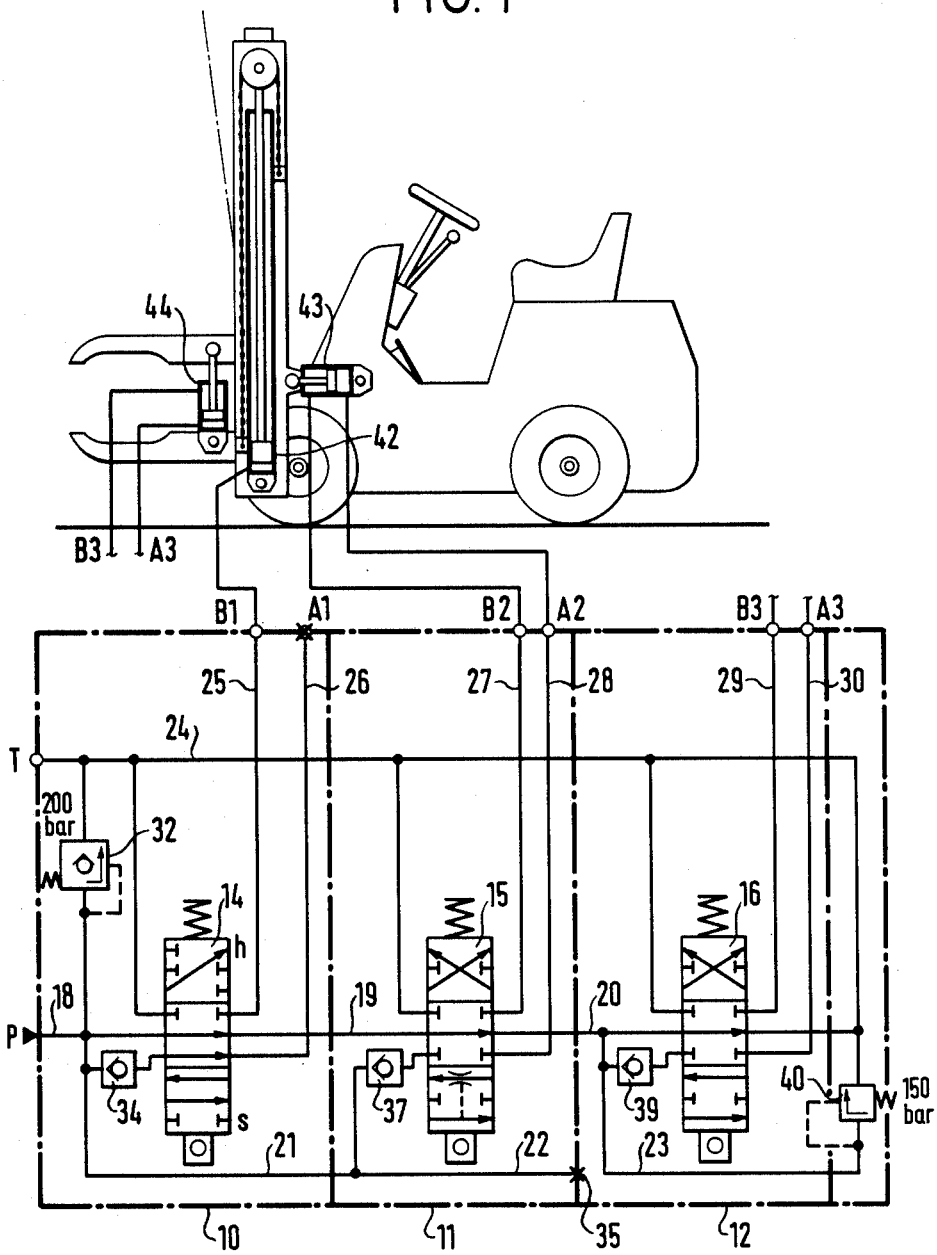

CONTROL BLOCK COMPRISING A PLURALITY OF VALVE UNITS FOR A PLURALITY OF HYDRAULIC DRIVES, IN PARTICULAR FORK LIFT TRUCKS

The invention relates to a control block comprising a plurality of valve units for a plurality of hydraulic drives, in particular fork lift trucks, having the features set forth in the preamble of claim 1.

When various drives are present, for example the lifting cylinder, the tilting cylinder and other auxiliary drives of mobile equipment, in particular a fork lift truck, it is necessary to subject certain drives to a high pressure and other drives to a lower pressure. Thus, in a fork lift truck the greatest available pressure should be supplied to the lifting cylinder.

It is known (DE-OS No. 3,510,283) to provide for such a control block two pressure-limiting valves adjustable to different pressures. The individual valve units each comprise a valve spool which can be displaced from a middle control position in which a circulating conduit connected to the fluid source is switched to pressureless circulation into one of two working positions in which a parallel passage possibly provided with a load holding check valve is connected to the conduit leading to the drive. The pressure-limiting valve adjustable to the higher pressure is disposed on the inlet side upstream of the first valve unit whilst the second pressure-limiting valve adjustable to the lower pressure is connected to a pressure line of the associated valve unit connected on the outlet side to the associated drive. Thus, as long as the control spool of this valve unit is held in the control position for pressureless circulation the second pressure-limiting valve is operative so that all drives actuated with the valve units lying downstream of said valve unit are subjected to the reduced pressure. With this arrangement it is however possible to subject a drive associated with a following valve means to the high pressure. If several drives are to be supplied with fluid at the high pressure a corresponding valve unit must be disposed upstream of the valve unit which has the pressure-limiting valve for the lower pressure. This is however not always desirable because in many control blocks a certain order of the valve units must be observed with regard to their allocation to the drives. The known control block is thus not suitable for certain applications because the pressure-limiting valve with the lower pressure is connected to a free working conduit not connected to the associated drive.

The problem to be solved is thus that of connecting the pressure-limiting valve for the lower pressure to the control block in such a manner that drives which are associated with valve units downstream of the first inlet-side valve unit can also be subjected to the high pressure. Furthermore, the control block is to be made as simply as possible without additional conduit connections being necessary for this purpose.

Said problem is solved by the features set forth in the claims.

Figure 2:
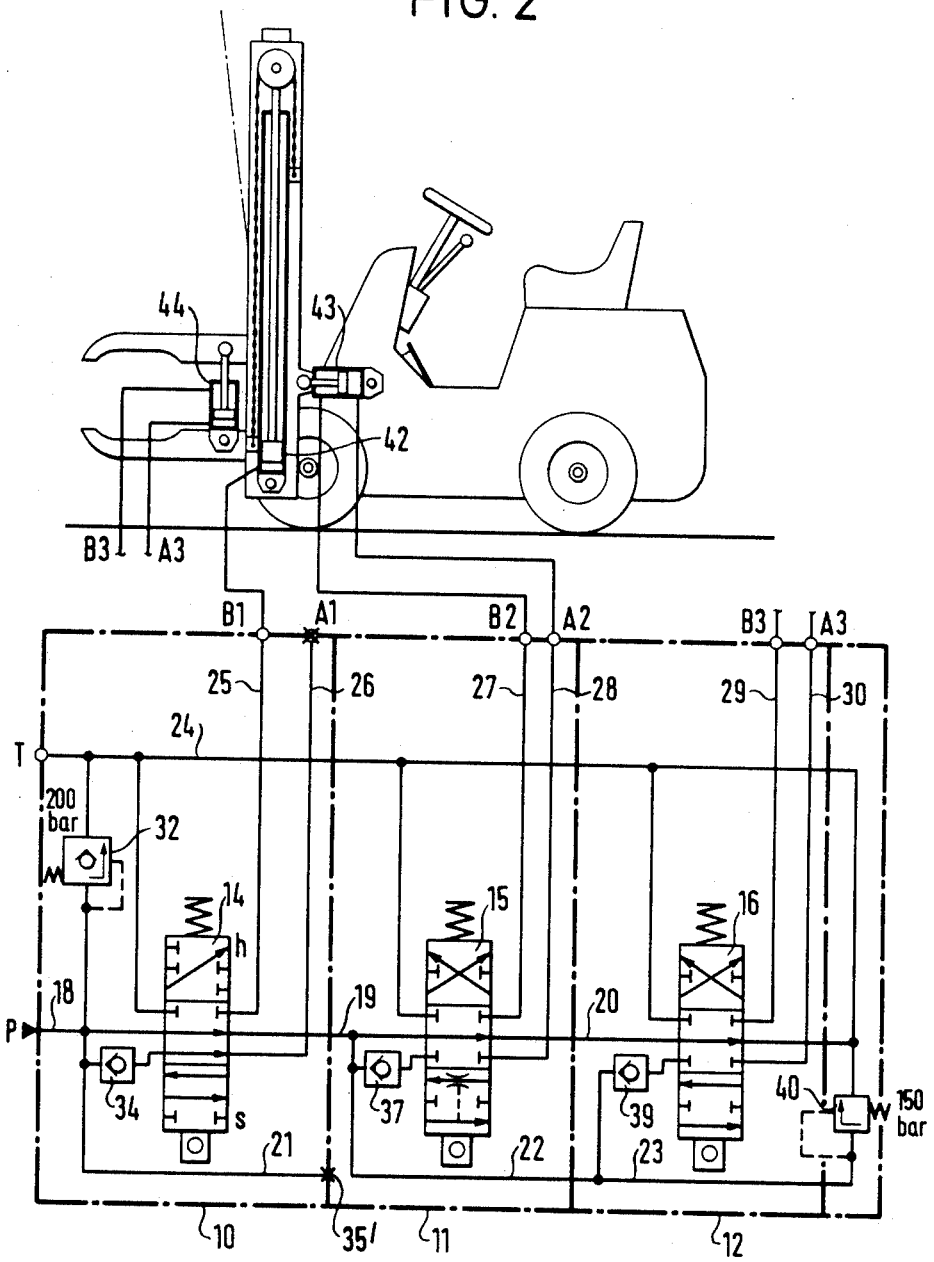

The invention will be explained in detail hereinafter with the aid of the drawings, wherein:

FIG. 1 is a circuit diagram in which the lifting cylinder and the tilting cylinder of a fork lift truck can be supplied with fluid at high pressure and FIG. 2 is a circuit diagram in which only the lifting cylinder can be supplied with fluid at high pressure.

In FIG. 1 a control block is made up of three valves 10, 11 and 12, each of which comprises a directional valve 14, 15 and 16. Each valve means 10, 11 and 12 is provided with a circulating passage 18, 19, 20, a parallel passage 21, 22, 23, a return passage 24 connected to a tank T and conduits 25, 26, 27, 28, 29 and 30 leading to the connections A1 and B1 as well as A2, B2 and A3, B3.

In the illustrated middle position of the valve spool of the valves 14, 15 and 16 the pressure circulating passage 18, 19 and 20 connected to the fluid source P are connected to the return conduit 24, i.e. switched to pressureless circulation. Upstream of the first valve 14 there is a pressure-limiting valve 32 which is set to a high first pressure, for example 200 bar. The pressure connection of the valve 14 is connected via a load-holding valve 34 to the circulating passage 18 upstream of the valve 14, as is also the associated parallel passage 25 which opens into the parallel passage 22 of the following valve 15 which is shut off at 35 whilst the pressure connection of the valve 15 is connected via a load-holding valve 37 to the parallel passage 22.

Downstream of the outlet-side last valve 16 of the control block a pressure-limiting valve 40 is provided between the parallel passage 23 and the return conduit 24 and can be set to a lower pressure, for example 150 bar. The pressure connection of the valve 16 is connected via a load-holding valve 39 to the circulating passage 20. The parallel passage 23 is likewise connected to the circulating passage 20.

In a fork lift truck the sequence of the valves 14, 15 and 16 for actuating the lifting cylinder 42, a tilting cylinder 43 and a further auxiliary drive 44 is predefined in that order. If the valve spool of the valve 14 is brought into the position denoted by h the circulating passage 18 to the circulating passage 19 or 20 of the following valves is shut off and fluid is supplied via the opening load-holding valve 34 and the conduit 25 and the connection B1 to the lifting cylinder 42. In this case the pressure-limiting valve 32 is operative and is set to the higher pressure. If the lifting cylinder is to be lowered the valve 14 is brought into the position s in which the fluid displaced by the piston of the lifting cylinder 42 via the conduit 25 flows into the return conduit 24 whilst the connection from the circulating passage 18 to the circulating passage 19 is open. Since the lifting cylinder 42 is a single-acting cylinder the connection A1 of the conduit 26 is closed.

Depending on the position of the control slide or spool of the valve 15 fluid is conducted via the parallel passages 21 and 22 into the conduits 27 or 28 and thus to the tilting cylinder 43. Thus, the pressure-limiting valve 32 is also operative for the tilting cylinder.

In contrast the working connection of the output-side valve 16 is connected via the load-holding valve 39 to the circulating passage 20 which is secured by the pressure-limiting valve 40. Thus, the auxiliary drive 44 receives fluid only when the two preceding valves 14 and 15 are in the middle position. In this control position the pressure-limiting valve 40 becomes effective so that on actuation of the valve spool of the valve 16 the auxiliary drive 44 can be actuated with the lower pressure.

With the circuit illustrated, both upstream and downstream of the valves 14 and 15 further valves can be inserted which operate drives for which the pressure-limiting valve 32 is then also effective. The transition to the lower pressure stage, for which the pressure-limiting valve 40 is operative, is governed by the connection of the associated parallel passage 23 to the circulating passage 20, the parallel passage 22 of the preceding valve being shut off at 35.

This is illustrated in FIG. 2 in which all the components are completely identical to those of FIG. 1 with the exception that the parallel passage 21 of the valve 14 is interrupted at 35' whilst the parallel passages 22 and 23 of the valves 15 and 16 are connected together and the connection of the parallel passage 22 to the circulating passage 19 is effected. In this manner the pressure-limiting valve 40 is now operative for the cylinders 43 and 44 associated with the valves 15 and 16 and the pressure-limiting valve 32 only for the lifting cylinder 42.

The pressure-limiting valve 40 in the form of a screw-in cartridge is screwed into the mouth, open in any case, of the parallel passage 23 at the third valve 16, giving a very simple construction. By the choice of the connection of the associated parallel passage to the circulating passage between two valves the pressure stages may be separated. Upstream of the connection the pressure-limiting valve 32 is effective and downstream of the connection point the pressure-limiting valve 40. This gives extensive freedom in the selection of the pressure stages to be set by the valves.

I claim:

1. Control block comprising a plurality of valve units for a plurality of hydraulic drives, each drive being controlled by one of said valve units, each of said valve units having valve means movable between a first position for applying fluid pressure to the associated drive, a second position for relieving fluid pressure from the associated drive and a third position for the pressureless circulation of the fluid via a circulation passage extending through the valve units, a parallel passage formed in the valve unit and connected to the circulation passage of that valve unit, the circulation passages of said valve units being connected to each other and to a fluid source, upstream of the first valve unit, a first pressure-limiting valve adjustable to a first pressure is connected to the circulation passage and to a pressure source and a second pressure-limiting valve adjustable to a second lower pressure connected to the parallel passage of one of the valve units for supplying at least one of the drives fluid the higher pressure set by said first pressure-limiting valve and to at least one of remaining drives fluid at a lower pressure set by said second pressure-limiting valves, characterized in that the second pressure-limiting valve is connected to the parallel passage of the last valve unit of the control block and all valve units lying upstream of the connection of the parallel passages leading to the second pressure-limiting valve are subjected to the first pressure and all valve units lying downstream of that connection are subjected to the second pressure.

2. Control block according to claim 1, characterized in that the valve units associated with the drives are disposed in a predetermined order in the control block.

3. Control block according to claim 2 characterized in that there are at least three valve units and the inlet-side first valve unit is provided for actuating a lifting cylinder of a forklift truck, the next valve unit is provided for actuating a tilting cylinder and a third outlet-side valve unit is provided for actuating an auxiliary drive.

4. Control block according to claim 1 characterized in that there are three valve units and the second pressure-limiting valve is connected via the parallel passage of the third outlet-side valve unit to the circulating conduit of the second valve unit, the parallel passage of the second valve unit is connected to the parallel passage of the first valve unit, the drives associated with the first and second valve units being subjected to the first pressure and the drive associated with the third outlet-side valve unit being subjected to the second pressure.

5. Control block according to claim 4 characterized in that on moving the first valve into the second position the circulating passage to the second unit remains open and the conduit leading to the drive controlled by the first valve unit is connected to a conduit connected to a tank.

6. Control block according to claim 4 characterized in that the inlet-side first valve unit is provided for actuating a lifting cylinder of a fork lift truck, the next valve unit is provided for actuating a tilting cylinder and a third outlet-side valve unit is provided for actuating an auxiliary drive.

7. Control block according to claim 2 characterized in that there are three valve units and the second pressure-limiting valve is connected via the parallel passage of the third outlet-side valve unit to the circulating conduit of the second valve unit, the parallel passage of the second valve unit is connected to the parallel passage of the first valve unit, the drives associated with the first and second valve units being subjected to the first pressure and the drive associated with the third outlet-side valve unit being subjected to the second pressure.

* * * * *

UNITED STATES PATENT AND TRADEMARK OFFICE

CERTIFICATE OF CORRECTION

PATENT NO. : 4,745,844

DATED : May 24, 1988

INVENTOR(S) : Sonke Larsen

It is certified that error appears in the above-identified patent and that said Letters Patent is hereby corrected as shown below:

Column 3, line 36, claim 1, "the" (first occurrence) should be --each--.

Column 4, line 12, claim 3, "forklift" should be --fork lift--.

Signed and Sealed this

Seventh Day of November, 1989

*Attest:*

JEFFREY M. SAMUELS

*Attesting Officer*

*Acting Commissioner of Patents and Trademarks*